US010799008B2

(12) United States Patent
Perullo et al.

(10) Patent No.: US 10,799,008 B2
(45) Date of Patent: Oct. 13, 2020

(54) LOW PROFILE MEDICAMENT CONTAINER

(71) Applicants: Bianca Rose Perullo, Rowley, MA (US); John Francis Perullo, Rowley, MA (US)

(72) Inventors: Bianca Rose Perullo, Rowley, MA (US); John Francis Perullo, Rowley, MA (US)

( * ) Notice: Subject to any disclaimer, the term of this patent is extended or adjusted under 35 U.S.C. 154(b) by 0 days.

(21) Appl. No.: 15/732,809

(22) Filed: Dec. 30, 2017

(65) Prior Publication Data

US 2019/0289983 A1 Sep. 26, 2019

(51) Int. Cl.

| | |
|---|---|
| ***B43K 5/06*** | (2006.01) |
| ***A45D 40/06*** | (2006.01) |
| ***A45D 40/02*** | (2006.01) |

(52) U.S. Cl.

CPC ..... *A45D 40/06* (2013.01); *A45D 40/02* (2013.01)

(58) Field of Classification Search

CPC ..... A45D 40/02; A45D 40/023; A45D 40/04
USPC ..... 401/68, 75, 82, 175, 176
See application file for complete search history.

(56) References Cited

U.S. PATENT DOCUMENTS

| | | | | |
|---|---|---|---|---|
| 3,612,705 | A * | 10/1971 | Duval | A45D 40/04 401/75 |
| 6,817,799 | B1 * | 11/2004 | Petit | A45D 40/04 401/172 |
| 8,961,048 | B2 * | 2/2015 | Baines | A45D 40/04 401/172 |
| 9,375,070 | B2 * | 6/2016 | Tsuhara | A45D 40/06 |
| 2004/0213624 | A1 * | 10/2004 | Petit | A45D 40/02 401/100 |

* cited by examiner

*Primary Examiner* — Jennifer C Chiang

(57) ABSTRACT

A low profile medicament container and dispenser is provided for dispensing medicaments such as lip balm to the lips or skin of a user. The cross-section of the body portion of the container has a major axis and a minor axis and the minor axis dimension is 50% or less of the major axis dimension. The container supports medicament from breakage during dispensing with sidewalls configured to have a soft lip engagement surface to reduce the distance medicament must be advanced beyond the container. The lip engagement surface may be formed from a lower durometer material than the body of the container. The medicament may be advanced with a thumb actuated slide mechanism or rotatable lead screw arrangement with a shaped knob to maintain the low profile shape of the container.

6 Claims, 10 Drawing Sheets

LOW PROFILE MEDICAMENT CONTAINER

PRIORITY

This application claims priority to U.S. Provisional Application Ser. No. 62/498,666 filed Dec. 31, 2016.

FIELD OF THE INVENTION

The present invention relates to containers and dispensers for personal medicaments. In particular the invention relates to containers, dispensers and applicators for materials applied to the lips or skin such as lip balm or lipstick.

BACKGROUND OF THE INVENTION

Containers for medicaments such as lip balm or lipstick are well-known in the art and come in a variety of shapes and sizes. The most common configuration of such prior art containers is a rigid cylindrical sleeve that receives a corresponding cylindrically shaped mass of medicament material in it is interior. The material is selectively translated longitudinally out of the container on a support that is driven by a lead screw arrangement. The lead screw advancement is connected to a portion of the container cylinder or separate wheel at the end of the cylinder. A user grasps that wheel portion and rotates it relative to the remaining portion of the cylindrical container to advance the material out from an open end. The portion of the material that is advanced out of the container then may be applied directly to the lips. After application the user may reverse the lead screw mechanism to retract the material back into the cylinder. Alternatively, if not advanced too far beyond the opening of the cylinder, it may be left unretracted. After use, a cap may be placed over the cylindrical container. The cylindrical container effectively and conveniently stores a lip medicament, and its round cross-section provides strength to protect the soft medicament material so that it remains intact and extendable in the container. However, the cylindrical configuration of the container prevents a low profile shape that can be concealed easily in clothing.

Another type of prior art medicament container used for lip balm employs a spherical shape for novelty appeal. The medicament is fixed and does not extend or retract relative to the container. Instead the user accesses the material by unscrewing a cap that is the top half of the sphere. The material may then be applied to the lips. A novelty spherical container is commercialized under the brand name EOS®. The bulbous shape of the spherical container is not compact. The container has a handle portion and a cap portion, which unscrews and separated from the based portion. Removal of the cap reveals a bolus of medicament attached to the base. The large rounded bolus of lip balm, in this instance, has a broad surface for application onto the lips and does not face support issues during application. However, the bulbous container shape is not easily concealed in a pocket of clothing.

It would be desirable to provide a low-profile medicament container that securely stores the medicament when not in use and reliably dispenses the medicament when the user chooses to apply it. It is an object of the present invention to provide such a medicament container and dispenser.

SUMMARY OF THE INVENTION

The present invention provides a low profile medicament container comprising a body portion having an opening at one end, a lip engagement surface formed at the open end of the body formed by tapering the thickness of body sidewalls infinitely to zero, a medicament advancement mechanism arranged to translate longitudinally through the container, wherein the cross-section of the body portion of the container has a major axis and a minor axis and the minor axis dimension is 50% or less of the major axis dimension.

In another aspect of the invention the low profile medicament container may have a minor axis dimension is 33% or less of the major axis dimension.

In another aspect of the invention the low profile medicament container may have a minor axis dimension is 25% or less of the major axis dimension.

In another aspect of the invention the medicament advancement mechanism may comprise a slide mechanism having force translation frame with slide pads to permit sliding through the body.

In another aspect of the invention the low profile medicament container as described above may have a medicament advancement mechanism that comprises a lead screw arrangement having an external rotatable knob shaped to match the cross-sectional shape of the body portion of the container In another aspect of the invention the low profile medicament container as described above may have a lip engagement surface formed on an inner sleeve received in an outer shell forming the body portion and the inner sleeve is of lower durometer material than the outer shell.

In another aspect of the invention the low profile medicament container as described above may have a lip engagement surface is formed on an insert placed on the open end of the body and the insert has a lower durometer than the body material.

BRIEF DESCRIPTION OF THE DRAWINGS

The foregoing and other objects and advantages will be appreciated more fully from the following further description thereof, with reference to the accompanying diagrammatic drawings wherein.

DESCRIPTION OF THE ILLUSTRATIVE EMBODIMENTS

Figure 1A:
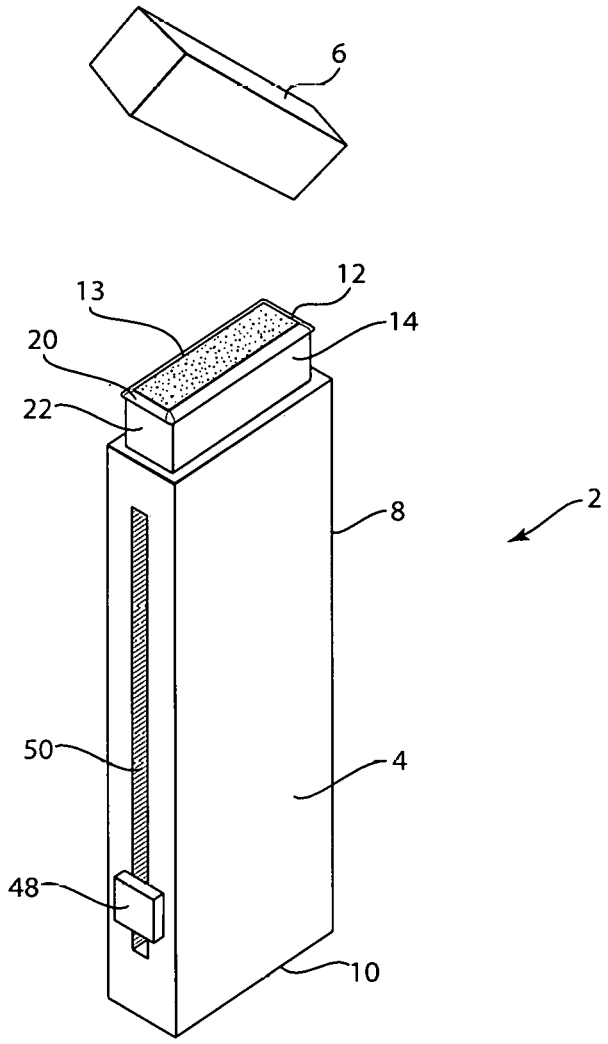
FIG. 1A is an isometric view of the low profile medicament container of the present invention.

FIG. 1A is an isometric view of a medicament container and dispenser 2 of the present invention. In particular, the invention is configured also to be a convenient applicator for medicament such as lip balm or cosmetics such as lip stick to the lips. In this description the invention will be referred to as container but it is intended to encompass a device with functionality of a dispenser and applicator as well. The container 2 may comprise a body portion 4 and a removable cap 6 at one end to provide access to the medicament 13 contained inside. The cap 6 may be completely separable from the container body 4 and selectively secured with a snap fit or the cap may be hinged at one end to the body.

Figure 1B:
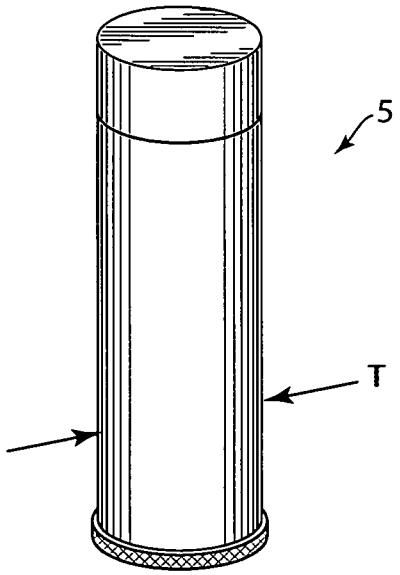
FIG. 1B Prior Art
FIG. 1B is a side view of a prior art device.
Figure 1C:
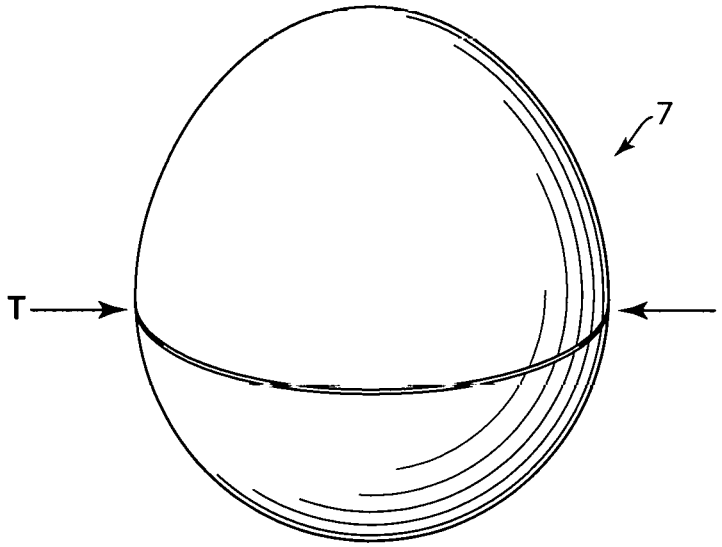
FIG. 1C Prior Art
FIG. 1C is a side view of a prior art device.

An important aspect of the invention is the container's low-profile shape, which provides an advantage over prior art devices in that it may be more conveniently carried by a user in the pocket of clothing or in a personal carry item such as cosmetic bag or purse. An unobtrusive size is especially important for a personal care item such as lip balm, which is desired to be brought along on the very occasions, such as social events or formal functions that seem to dictate sleek formal attire without carrying burdensome baggage or bulky items that may protrude from their pockets. Prior art containers such as cylinder 5 and sphere 7 are shown in prior art FIGS. 1B and 1C respectively. Such prior art containers have not focused on providing a low profile shape and their round cross-sectional bodies present a bulky profile that tends to bulge inside the pocket or handbag of a user. By way of example, the cylindrical prior art container may have a thickness (indicated as "T" in the figures) of approximately 1.6 cm and 4.2 cm for the spherical prior art container. It is an object of the present invention to provide a container that has a much reduced profile and thickness of the cylindrical prior art containers.

Figure 2A:
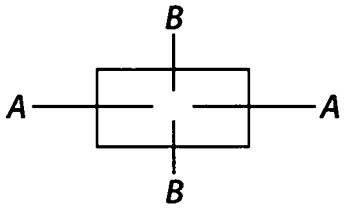
FIGS. 2A-2F are end views of different embodiments of the low profile medicament container having different cross sectional shapes.
Figure 2B:
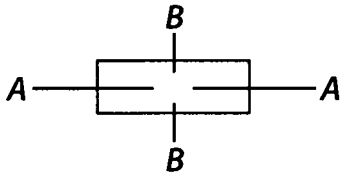
Figure 2C:
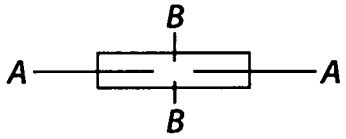
Figure 2D:
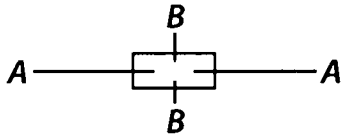

FIGS. 2A-2F show exemplary cross-sectional shapes for the container of the present invention. Each figure shows a representative end view of the container with major and minor axes defined as lines A-A and B-B respectively. In providing a "low profile" container, generally it is the intent of the invention to have the dimension of the minor axis of the container be only about 50% or less than the dimension of the container along its major axis. FIG. 2A shows an end view of the inventive container having a dimension along its major axis A-A of 2 cm and a dimension along the minor axis B-B of about 1 cm, or about 50% of the major axis dimension. FIG. 2B shows an end view of the inventive container having a dimension along its major axis A-A of 2 cm and a dimension along its minor axis B-B of about 0.7 cm, or about 33% of the major axis dimension. FIG. 2C shows an end view of the inventive container having a dimension along its major axis A-A of 2 cm and a dimension along its minor axis B-B of about 0.5 cm, or about 2.5% of the major axis dimension. FIG. 2D shows an end view of a smaller version of the inventive container having a dimension along its major axis A-A of 1.3 cm and a dimension along its minor axis B-B of about 0.5 cm, or about 38% of the major axis dimension. Any length of the container may be chosen to provide sufficient medicament capacity while not so long as to become awkward to carry. It is believed a length of between approximately 4 to 9 cm would be reasonable to attain the objectives of the invention.

Figure 2E:
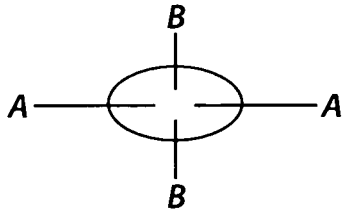
Figure 2F:
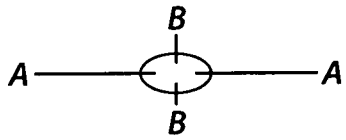

The inventive container need not have a rectangular cross-sectional shape. Other cross-sectional shapes are possible. However, to maintain the low-profile nature of the container, it is preferred that the cross-sectional shape have a major axis and a minor axis and that the minor axis be about 50% or less of the major axis dimension. Following these dimensional principles enables the container to meet the low-profile objectives outlined above. FIG. 2E shows a container having a more rounded cross-sectional shape, using a minor axis of about 50% of the major axis results in a somewhat oval shape. The example shown in FIG. 2E, has a major axis dimension of about 2 cm and a minor axis dimension of about 1 cm, or about 50% of the major axis dimension. FIG. 2F has a major axis dimension of About 1 cm and a minor axis dimension of about 0.5 cm, or about 50% of the major axis dimension.

Referring to the exemplary inventive container shown in FIG. 1A, a body portion 4 of the container comprises an outer shell 8 having a closed end 10 and open end 12. The shell defines a cavity inside which is held medicament 13, such as wax-based lip balm. The shell may be made from any suitable, easily moldable polymer material with sufficient rigidity to provide a support structure to hold the medicament. Around the perimeter of the open end 12 of the shell may be formed a relief surface 14 configured to receive a cap 6 with a snap or friction fit. Beyond the relief surface, the open end 12 of the outer shell terminates with a wall thickness that preferably tapers infinitely to zero. The tapered thickness allows the side wall 22 of the shell to be somewhat flexible at the open end to provide a soft lip engagement surface 20 at the point where medicament exits the container and is drawn across the lips by the user. The lip engagement surface is important to the successful function of the invention.

Figure 3A:
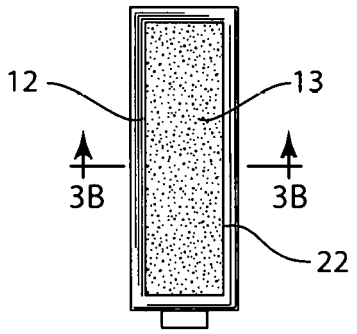
FIG. 3A is a top view of an embodiment of the low profile medicament container showing section line A-A.
Figure 3B:
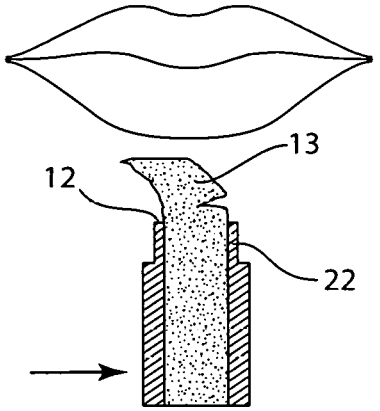
FIG. 3B is a sectional side view detail of a low profile medicament container taken along line A-A of FIG. 3A that does not have the improvements of the present invention showing application to the lips for reference
Figure 3C:
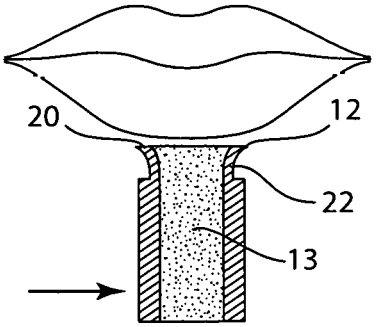
FIG. 3C is a sectional side view detail of a low profile medicament container taken along line A-A of FIG. 3A that employs improvements of the present invention showing application to the lips for reference.

With the low profile shape of the container, a wax-based medicament will also by necessity have a low profile cross-sectional shape in order to be contained inside. FIG. 3A shows a top view of a container. Because a column of wax-based material is not particularly strong to begin with, configuring the column with a low-profile cross-sectional shape without the container improvements of the present invention as shown in FIG. 3B, a cross-sectional detail taken along the line A-A of FIG. 3A, will make the product more fragile as bending force is applied while it is dragged across the lips in the rightward direction. A column of medicament 13 extended beyond the open end of the container would be unsupported by the side walls 22 of the shell and more susceptible to fracture under bending force during application. Fracture and loss of the medicament during application would cause user dissatisfaction with the product. As shown in FIG. 3C, a cross-sectional detail taken along the line A-A of FIG. 3A, but with the inventive soft lip engagement surface 20 employed, the medicament material need only be extended approximately equal to or slightly beyond the open end 12 because contact between the shell and the lips will not cause irritation for the user. Because the user need not extend the medicament far beyond the shell to apply with comfort, the medicament column 13 remains almost entirely supported by the shell sidewalls 22 to resist bending forces during application onto the lips or skin. With the lip engagement surface 20 enabling the medicament to be fully supported by the shell sidewalls 22, a low-profile medicament container and applicator that does not challenge the strength of the medicament material is possible.

Figure 4A:
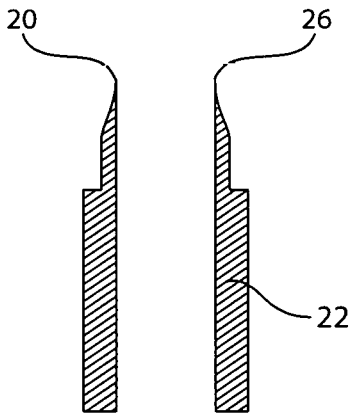
FIG. 4A is a sectional side view detail of a low profile medicament container taken along line A-A of FIG. 3A that employs improvements of the present invention.
Figure 4B:
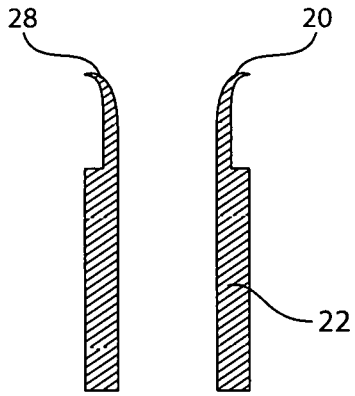
FIG. 4B is a sectional side view detail of a low profile medicament container taken along line A-A of FIG. 3A that employs improvements of the present invention.

Ideally, the shell material is a plastic of soft enough durometer so that the tapered lip engagement surface is flexible at its edge and soft upon touching of the lips. In a first embodiment of the invention, the shell, sidewalls and lip engagement surface are all formed from the same material, molded into different segments. In the detailed sectional side view in FIG. 4A (taken along the line A-A of FIG. 3A and with medicament removed for clarity), the lip engagement surface 20 of the sidewall 22 may taper straight to a straight edge 26 that is flexible to the touch. Alternatively, as shown in the detailed sectional side view of FIG. 4B, the lip engagement surface may be flared radially outward to present a planar surface 28 to the lips.

Figure 5A:
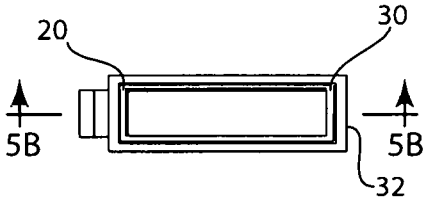
FIG. 5A is a top view of an embodiment of the low profile medicament container showing section line A-A.
Figure 5B:
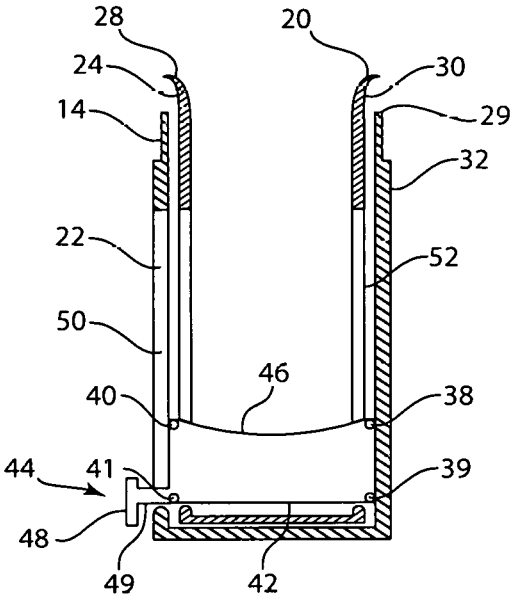
FIG. 5B is a sectional side view of an embodiment of the low profile medicament container taken along line A-A of FIG. 5A.
Figure 6:
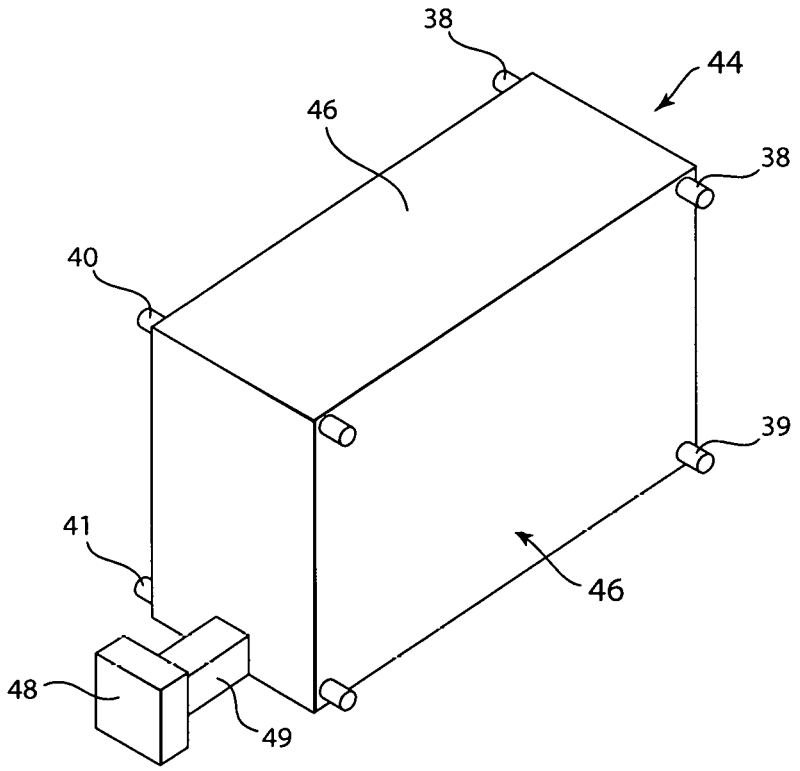
FIG. 6 is an isometric view of the slide mechanism of the present invention.

To help ensure a soft lip engagement surface while retaining a rigid protective shell, a second embodiment of the inventive container, shown in FIGS. 5A-5C. FIG. 5A is a top view of the container with cap and medicament removed. FIG. 5B shows a cross-sectional side view of the container taken along the line A-A of FIG. 5A. The container provides an inner shell 30 of a different material that is received inside the outer shell 32. In this embodiment, the outer shell may be formed of a plastic with sufficient durometer measure to ensure the needed stiffness and strength to protect the container and the medicament from crushing while being carried in a user's pocket. The inner shell may be formed from a polymer with a much softer durometer to provide for extremely soft lip engagement surface 20, which is formed on the inner shell opening 24. The inner shell opening 24 should extend beyond outer shell opening 29 so that only the lip engagement surface 20 and medicament 13 contact the lips during application. In this embodiment, the relief surface 14 is formed on the outer shell 32 below the opening 29 to receive a cap. The inner shell may be fixed to the outer shell by heat or adhesive bonding at any suitable location along their respective lengths.

The medicament 13 may be advanced out of the container using one of several known advancement mechanisms. Given the light weight and lubricity of the wax based material in question, one simple mechanism for advancing medicament is a direct slide. The slide mechanism 44 is best shown in FIGS. 1A, 5B, 6 and 7. The slide mechanism is especially convenient in a low profile medicament container because it permits a small actuator for advancement on the exterior of the container that itself is not bulky. Also, it permits one-handed operation for advancement of the medicament. The slide mechanism must translate the users input from the exterior of the container to cause the medicament to advance out of the container in a controlled fashion. The slide must move easily and not bind during sliding motion through the container cavity despite receiving an upward input force on only one side of the mechanism. The tendency of the sliding mechanism to become cocked and bind within the container cavity must be addressed.

To better cope with the rotational force that an upward push to just one side of the slide mechanism may impart, the slide uses a force translation frame 46. The frame is configured to space slide pads 38, 39, 40 and 41 above and across from the advancement force to help counter act rotation imparted when a user applies an inward and upward force on thumb pad 48. Looking at FIG. 5B, when a user pushes inward and upward on thumb pad 48, the force is translated through thumb shaft 49 to force translation frame 42, which distributes the force. In particular, the rotational force is resisted by upper outer slide pads 38, lower outer slide pads 39, upper inner slide pads 40 and lower inner slide pads 41. The slide pads are small rounded nodules molded to the force translation frame 42 to be low surface area contact points against the sidewalls 22 of the outer shell 32. The elevated location of the slide pads relative the thumb pad and shaft helps to counter act the upward pushing force applied to one side of the slide. The lower slide pads also help to keep the slide mechanism square in the shell cavity so smooth sliding is possible, to cause has a base 46 configured to hold the bottom of the medicament column and is configured to advance through the shell interior in a controlled fashion. A slot 50 cut through the sidewall of the outer shell permits the thumb shaft 49 to translate upward through the container. Slide pads are located to the outside of the slot area to remain in contact with the sidewall of the container. Slot 52 is made on both sides of inner shell 30 so that slide pads can engage the stiffer outer shell side walls. Medicament 13 resides on slide base 46 to move along with slide 44. The slide arrangement described here may be employed in all embodiments described herein regardless of whether an inner sleeve is employed.

Figure 7:
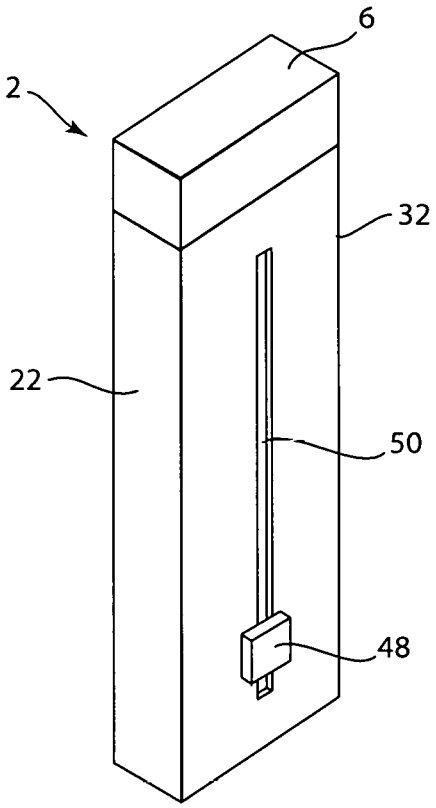
FIG. 7 is an isometric view of an alternate embodiment of the slide mechanism arrangement on the low profile medicament container.

In the above description, the slide mechanism has been shown on the minor axis side wall of the container, but it may alternatively be positioned on the major axis side wall of the container as shown in FIG. 7. Positioning of the slots 50 and 52 and arrangement and dimensions of the slide mechanism 44 components described above can be adjusted to fit this arrangement and permit operation in the same manner.

Figure 8:
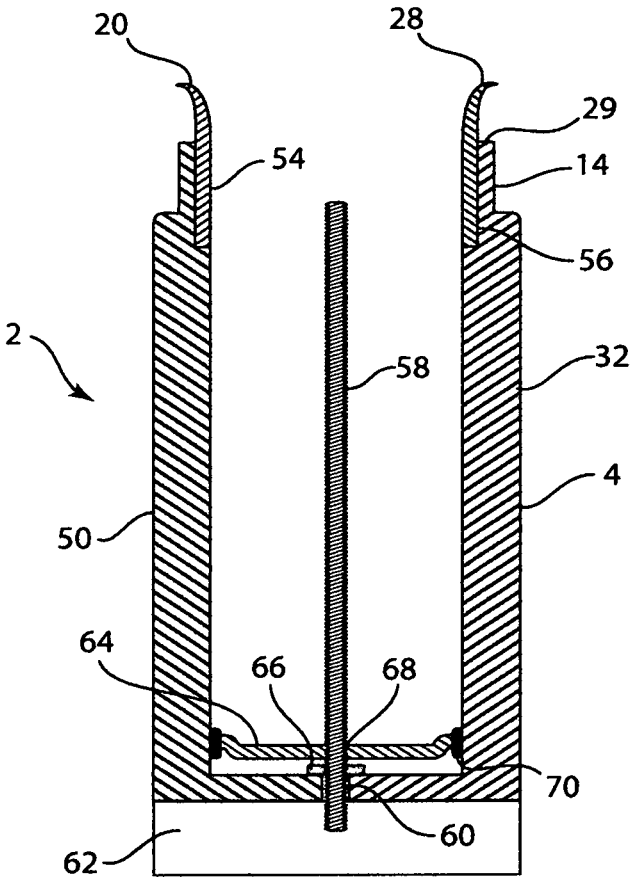
FIG. 8 is a sectional side view of an embodiment of the low profile medicament container taken along line A-A of FIG. 5A.

In another embodiment shown in FIG. 8, rather than employing a separate inner shell, a low durometer soft insert 54 is applied on the outer shell at its open end 29. To receive the insert, an inner relief 56 may be formed on the inside surface of the outer shell near its open end 29 to accommodate the thickness of the insert without altering the overall inside surface of the container through which the medicament must slide. The insert also extends outward from the shell opening 29 to provide the soft lip contact surface 20, away from the more rigid shell material during application of the medicament. An outer relief surface 14 applied near the shell open end 29 in order to receive a cap, as with the previous embodiments. Examples of soft insert materials are silicone or Teflon.

Also shown in FIG. 8 is an alternative advancement mechanism. The container may be fitted with a conventional lead screw arrangement to selectively advance medicament out of the container. As shown in FIG. 8 this arrangement includes a lead screw 58 rotatably positioned in a throughole 60 at the bottom of the body 4 of the container 2. The bottom end of the lead screw is fixed in a rotatable knob 62 accessible to the user for rotation. A locking washer 66 positioned around the lead screw an resting on the container body 4 bottom surface restrains the lead screw from longitudinal movement while permitting rotation. Medicament platform 64 receives the lead screw through a threaded throughole 68 and thus raises or lowers with rotation of the lead screw to advance medicament (not shown) positioned on top of it. Stabilizing slide pads 70 may be positioned on the edges of medicament platform 64 to engage the inner surface of the container sidewalls and keep the platform level during longitudinal movement through the container.

Figure 9:
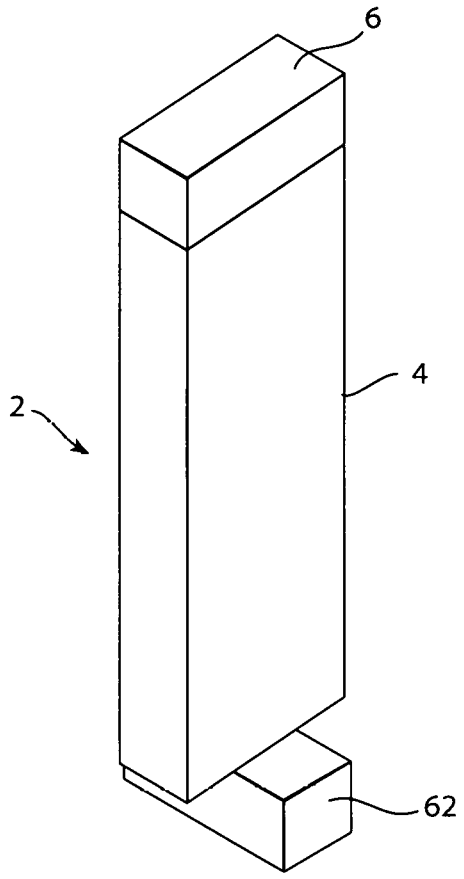
FIG. 9 is an Isometric view of the low profile medicament container having a lead screw medicament advancement mechanism with rotatable knob having the same cross sectional shape as the container body.

The knob 62 may be a conventional knurled round member as found on prior art devices or may be a rectangular or oval member shaped to match the profile of the container body 4 as shown in FIG. 9. The rectangular member may be rotated to advance medicament in 180 degree increments so that its profile returns to alignment with the rest of the container body thereby retaining the low profile shape of the container.

The invention claimed is:

1. A low profile medicament container comprising:

a body portion having an opening at one end, a lip engagement surface formed at the open end of the body formed by tapering the thickness of body sidewalls infinitely to zero on an insert placed at the open end of the body wherein the insert has a lower durometer than the body material, a medicament advancement mechanism arranged to translate longitudinally through the container wherein the cross-section of the body portion of the container has a major axis and a minor axis and the minor axis dimension is 50% or less of the major axis dimension.

2. A low profile medicament container as described in claim 1 where in the minor axis dimension is 33% or less of the major axis dimension.

3. A low profile medicament container as described in claim 1 where in the minor axis dimension is 25% or less of the major axis dimension.

4. A low profile medicament container as described in claim 1, wherein the medicament advancement mechanism comprises a slide mechanism having force translation frame with slide pads to permit sliding through the body.

5. A low profile medicament container as described in claim 1 wherein the medicament advancement mechanism comprises a lead screw arrangement having an external rotatable knob shaped to match the cross-sectional shape of the body portion of the container.

6. A low profile medicament container as described in claim 1 wherein the lip engagement surface is formed on an inner sleeve received in an outer shell forming the body portion and the inner sleeve is of lower durometer material than the outer shell.

* * * * *